US007582255B2

(12) United States Patent
Nakai et al.

(10) Patent No.: US 7,582,255 B2
(45) Date of Patent: Sep. 1, 2009

(54) WARM MOLDING RAW MATERIAL POWDER AND WARM MOLDING METHOD

(75) Inventors: Takashi Nakai, Niigata (JP); Kinya Kawase, Niigata (JP)

(73) Assignee: Mitsubishi Materials PMG Corporation, Niigata (JP)

( * ) Notice: Subject to any disclaimer, the term of this patent is extended or adjusted under 35 U.S.C. 154(b) by 0 days.

(21) Appl. No.: 10/596,004

(22) PCT Filed: Nov. 24, 2004

(86) PCT No.: PCT/JP2004/017383

§ 371 (c)(1),
(2), (4) Date: May 21, 2007

(87) PCT Pub. No.: WO2005/051577

PCT Pub. Date: Jun. 9, 2005

(65) Prior Publication Data

US 2008/0056929 A1 Mar. 6, 2008

(30) Foreign Application Priority Data

Nov. 25, 2003 (JP) ..... 2003-394534

(51) Int. Cl.
*B22F 3/02* (2006.01)
*B22F 3/12* (2006.01)

(52) U.S. Cl. ..... 419/66; 419/37

(58) Field of Classification Search ..... 75/252; 419/66, 36, 37, 65; 508/150
See application file for complete search history.

(56) References Cited

U.S. PATENT DOCUMENTS 6,001,150 A * 12/1999 McCall et al. ..... 75/255
6,140,278 A * 10/2000 Thomas et al. ..... 508/150
2001/0038802 A1* 11/2001 Ozaki et al. ..... 419/36
2002/0034453 A1* 3/2002 Kondo et al. ..... 419/10

FOREIGN PATENT DOCUMENTS

| | | |
|---|---|---|
| EP | 0 913 220 | 5/1999 |
| EP | 1 145 788 | 10/2000 |
| EP | 1 199 124 | 4/2002 |
| JP | 10-317001 | 12/1998 |
| JP | 2000-027350 | 1/2000 |
| JP | 2000-290703 | 10/2000 |
| JP | 2001-294902 A | 10/2001 |
| JP | 2001-342478 | 12/2001 |

OTHER PUBLICATIONS

International Search Report dated Mar. 8, 2005 issued for corresponding International Patent application No. PCT/JP2004/017383.

Thomas Y et al: "Influence of Temperature on Properties of Lithium Stearate Lubricant" Metal Power Report, MPR Publishing Services, Shrewsbury, GB, vol. 1, No. 3, Jan. 1, 1997, pp. 4-23, XP008028769.

* cited by examiner

*Primary Examiner*—Roy King
*Assistant Examiner*—Ngoclan T Mai
(74) *Attorney, Agent, or Firm*—Darby & Darby PC

(57) ABSTRACT

A hydroxy fatty acid salt having an average particle diameter of from 5 μm to 100 μm with a composition of from 0.3 wt % to 2 wt %, and more preferably, from 0.5 wt % to 2 wt % is added to a raw material powder in powder metallurgy, and worm molding is performed. In addition, a hydroxy fatty acid salt having an average particle diameter of 50 μm or less is attached on a mold in advance, and after that, the warm molding is performed. As a hydroxy fatty acid salt, 12-hydroxy lithium stearate is suitably used.

8 Claims, 2 Drawing Sheets

[Fig. 1]
RESULTS OF THERMAL ANALYSES OF LITHIUM STEARATE
(ANALYZED WEIGHT: 5mg, IN THE ATMOSPHERE)
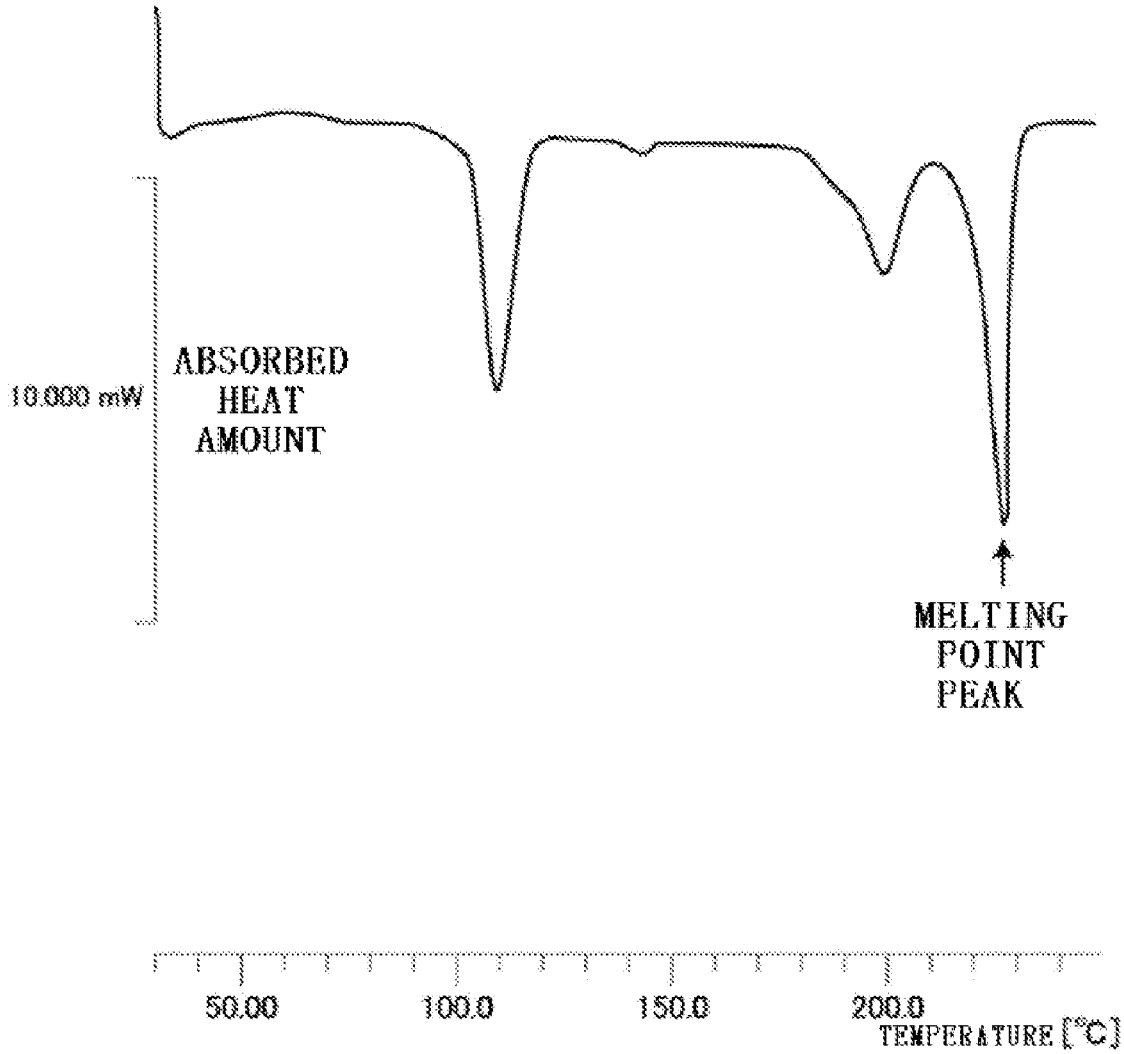

[Fig. 2]
RESULTS OF THERMAL ANALYSES OF 12-HYDROXY LITHIUM STEARATE
(ANALYZED WEIGHT: 7mg, IN THE ATMOSPHERE)
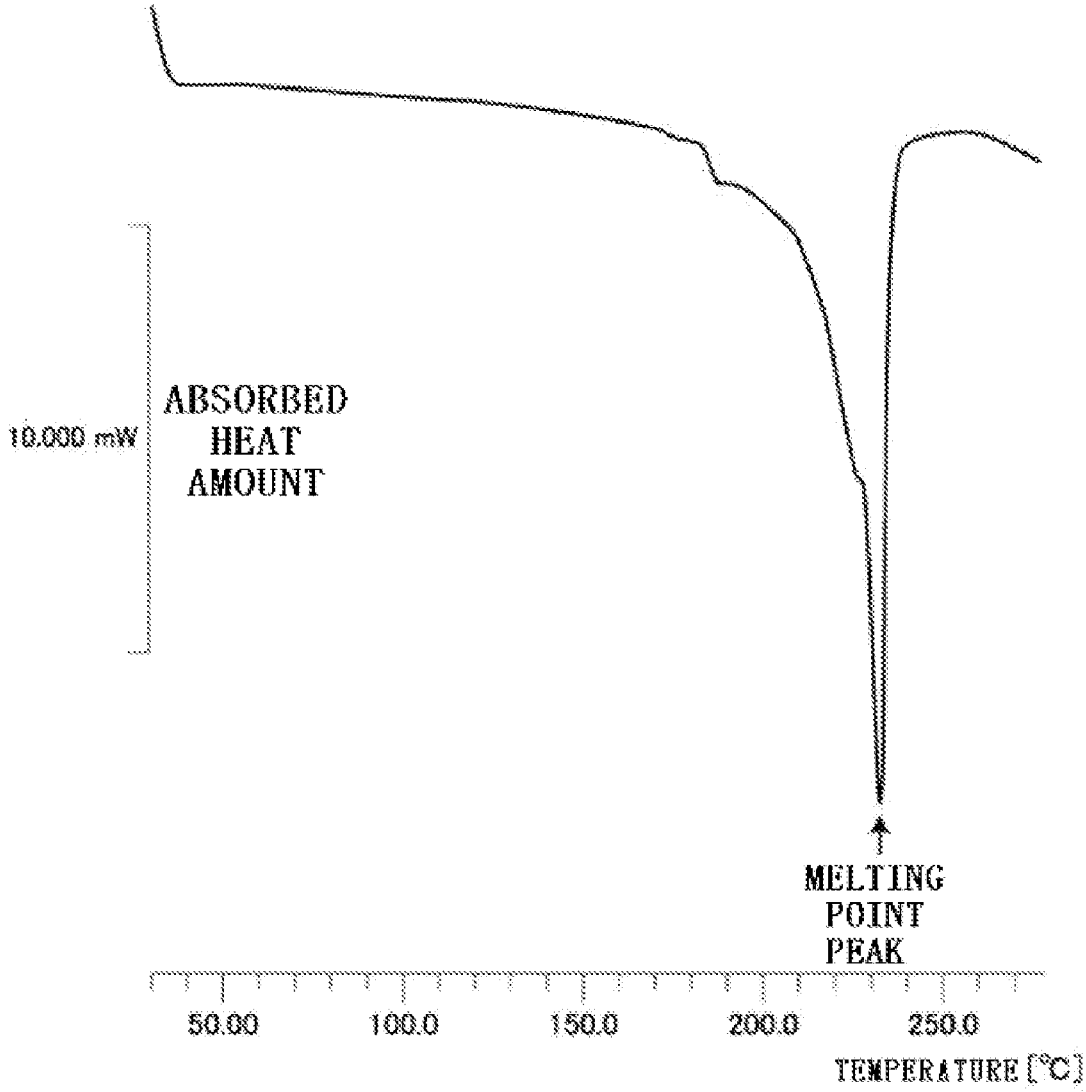

WARM MOLDING RAW MATERIAL POWDER AND WARM MOLDING METHOD

This application is a U.S. National Phase Application under 35 U.S.C. §371 of International Patent Application No. PCT/JP2004/017383, filed Nov. 24, 2004, and claims the benefit of Japanese Application No. 2003-394534 filed Nov. 25, 2003. The International Application was published in Japanese on Jun. 9, 2005 as WO 2005/051577 A1 under PCT Article 21(2).

TECHNICAL FIELD

The present invention relates to a warm molding raw material powder formed by mixing a raw material powder with lubricant in the field of powder metallurgy and a warm molding method.

BACKGROUND ART

Conventionally, in the field of powder metallurgy, in case of filling a raw material powder in a mold and warm press-molding a formed body, in order to improve a flowing property of the raw material powder at a time of filling the raw material powder in the mold and to improve a pressing property of the formed body by increasing a lubricating property between raw material powders and between the raw material powder and the mold at a time of press-molding the formed body, a warm molding raw material powder formed by mixing the raw material powder with lithium stearate as a lubricant is generally used as a raw material in the powder metallurgy. However, in a case where the lithium stearate is mixed, although a melting point of the lithium stearate is about 220° C., there is a problem in that, if the raw material powder is heated at a temperature of 150° C. or more, the flowing property of the raw material powder deteriorates. In addition, there is a problem in that sufficient lubricating and pressing properties cannot be obtained by using the lithium stearate.

As disclosed in Japanese Unexamined Patent Application Publication No. 2000-27350, it is known that the flowing property of the raw material powder can be improved by adding a small amount of fatty acid metallic salt having an average particle diameter of 4 μm. However, the lubricating property at the time of press-molding cannot be obtained by adding such a small amount of the fatty acid metallic salt. In addition, generally, if an amount of the fatty acid metallic salts suitable to obtain the flowing property is added, the flowing property is lowered. In addition, since production cost of the fatty acid metallic salt having a very small particle diameter is higher than that of a general fatty acid metallic salt, there is a problem in that the fatty acid metallic salt having such a very small particle diameter is uneconomical.

In addition, as disclosed in Japanese Unexamined Patent Application Publication No. 2001-294902, there is proposed a technique of using a lubricant containing components having a low melting point below a press-molding temperature. However, if the lubricant containing the low melting point lubricating component is heated at a temperature exceeding the warm molding temperature, there is a problem in that the flowing property of the raw material powder cannot be obtained.

SUMMARY OF THE INVENTION

The present invention is contrived to solve the aforementioned problem. An object of the present invention is to provide a warm molding raw material powder having a good flowing property at a high temperature, high lubricating and pressing properties at a time of press-molding, and being highly economical and a warm molding method using the warm molding raw material powder.

By taking into consideration of the aforementioned object, the inventors found out that, if 12-hydroxy lithium stearate having an average particle diameter of from 5 μm to 100 μm with a composition of from 0.3 wt % to 2 wt % as a lubricant is mixed to the raw material powder in powder metallurgy, the flowing property of the raw material powder at a time of heating at a temperature exceeding 150° C. does not deteriorate, and higher lubricating and pressing properties at a time of pressing-molding than those of a case of using lithium stearate can be obtained. In addition, generally, it is well known that the 12-hydroxy lithium stearate is used to increase adhesiveness of grease. In powder metallurgy, the 12-hydroxy lithium stearate is simply used to be mixed to a lubricating component having a melting point below warm molding temperature. Therefore, a case of using a single 12-hydroxy lithium stearate has not been known.

According to the present invention, there is provided a warm molding raw material powder, a composition of hydroxy fatty acid salt having an average particle diameter of from 5 μm to 100 μm is in a range of from 0.3 wt % to 2 wt %.

According to the present invention, there is provided a warm molding raw material powder, a composition of a hydroxy fatty acid salt having an average particle diameter of from 5 μm to 100 μm is in a range of from 0.5 wt % to 2 wt %.

According to an aspect of the present invention, in the warm molding raw material powder according to the above, a lubricant having a melting point below a warm molding temperature is not contained.

According to the present invention, in the warm molding raw material powder according to any one of the above, the hydroxy fatty acid salt is a hydroxy stearic acid salt.

According to the present invention, in the warm molding raw material powder according to the above, the hydroxy stearic acid salt is hydroxy lithium stearate.

According to an embodiment of the present invention, in the warm molding raw material powder according to the above, the hydroxy lithium stearate is 12-hydroxy lithium stearate.

According to the present invention, there is provided a warm molding method performed by using the warm molding raw material powder according to the above.

According to the present invention, in the warm molding method according to the above, in powder metallurgy, after a hydroxy fatty acid salt having an average particle diameter of 50 μm or less is attached on a mold, warm molding is performed.

According to the present invention, in the warm molding method according to the above, the hydroxy fatty acid salt is a hydroxy fatty acid lithium.

According to an embodiment of the present invention, in the warm molding method according to the above, the hydroxy fatty acid lithium is hydroxy lithium stearate.

According to the present invention, in the warm molding raw material powder according to the above, the hydroxy lithium stearate is 12-hydroxy lithium stearate.

According to the warm molding raw material powder and the warm molding method of the present invention, the flowing property of the raw material powder at a time of heating at a temperature exceeding 150° C. does not deteriorate, and higher lubricating and pressing properties at a time of pressing-molding than those of a conventional case of using lithium stearate can be obtained. In addition, the 12-hydroxy lithium stearate having an average particle diameter of from 5

μm to 100 μm can be easily and economically obtained by directly reacting a lithium compound with a 12-hydroxy stearic acid originated from inexpensive castor oil. Therefore, it is possible to reduce production cost thereof.

BRIEF DESCRIPTION OF THE DRAWINGS

FIG. 1 is a graph showing a result of a thermal analysis of lithium stearate.

FIG. 2 is a graph showing a result of a thermal analysis of 12-hydroxy lithium stearate.

DETAILED DESCRIPTION OF THE INVENTION

Now, preferred embodiments of the present invention will be described.

The warm molding raw material powder according to the present invention contains a hydroxy fatty acid salt having an average particle diameter of from 5 μm to 100 μm. Here, the average particle diameter denotes a particle size measured by using a microscopic method, a precipitation method, a laser diffraction scattering method, a laser Doppler method, or other well-known methods.

Generally, in case of a hydroxy fatty acid salt having an average particle diameter below 5 μm, if an amount thereof enough to obtain the lubricating property of the raw material powder is added, the flowing property of the raw material powder deteriorates. Therefore, it is not preferable that the average particle diameter of the hydroxy fatty acid salt is less than 5 μm.

In terms of the flowing property, a hydroxy fatty acid salt having such a small average particle diameter of from 5 μm to 100 μm is generally manufactured by using a method of reacting a hydroxy fatty acid alkali metallic salt with an organic metallic salt in a wet manner. However, since the initial raw material is aqueous hydroxy fatty acid sodium or potassium salt, a hydroxy fatty acid salt of lithium having a higher ionization tendency than sodium or potassium cannot be manufactured by using the conventional method. As described later, since the hydroxy fatty acid salt of lithium is suitably used in the present invention, it is not preferable that the average particle diameter of the hydroxy fatty acid salt is less than 5 μm.

If average particle diameter of the hydroxy fatty acid salt is more than 100 μm, in a sintering process, the hydroxy fatty acid salt is removed by heating decomposition or evaporation, so that large-sized holes remain. As a result, a final powder metallurgy product may have a poor outer appearance and a weak mechanical strength. Therefore, it is not preferable that the average particle diameter of the hydroxy fatty acid salt is more than 100 μm.

The warm molding raw material powder according to the present invention contains a hydroxy fatty acid salt with a composition of from 0.3 wt % to 2 wt %. If a composition of the hydroxy fatty acid salt is less than 0.3 wt %, a sufficient lubricating property of the raw material powder cannot be obtained. Therefore, it is not preferable that a composition of the hydroxy fatty acid salt is less than 0.3 wt %. If a composition of the hydroxy fatty acid salt is more than 2 wt %, the pressing property deteriorates, so that the warm molding may be performed meaningless. Therefore, it is not preferable that a composition of the hydroxy fatty acid salt is more than 2 wt %. In some cases, with a composition of from 0.3 wt % to 0.5 wt %, the lubricating property may not be obtained according to a size of a product or a surface state of a mold. Therefore, it is more preferable that a composition of the hydroxy fatty acid salt is in a range of from 0.5 wt % to 2 wt %.

The warm molding raw material powder according to the present invention contains does not contain a lubricant having a melting point below a warm molding temperature. Here, the warm molding temperature is a temperature of a raw material powder at a time of press-molding. If the warm molding temperature is less than 70° C., a density of a formed body is lowered, so that an effect of the warm molding cannot be obtained. If the warm molding temperature is more than 190° C., the flowing property of the lubricant according to the present invention may deteriorate, and the raw material powder may be oxidized. Therefore, it is preferable that the warm molding temperature is in a range of from 70° C. to 190° C. The configuration that, the present invention contains does not contain a lubricant having a melting point below a warm molding temperature denotes that a lubricant of which adhesiveness increases due to fusion or change in crystal structure at a temperature below the warm molding temperature excluding inevitable impurities cannot be contained. In addition, since the lubricant having a melting point below the warm molding temperature is not contained, although the raw material powder is heated at a temperature exceeding the warm molding temperature, the lubricant is not fused, so that the flowing property of the raw material powder does not deteriorate.

As an example of the hydroxy fatty acid salt according to the present invention, there are hydroxy fatty acid metallic salts formed by adding hydroxy groups to stearic acid ($C_{17}H_{35}COOH$), oleic acid ($C_{17}H_{33}COOH$), linoleic acid ($C_{17}H_{31}COOH$), linolenic acid ($C_{17}H_{29}COOH$), palmitic ($C_{15}H_{31}COOH$), myristic acid ($C_{13}H_{27}COOH$), lauric acid ($C_{11}H_{23}COOH$), capric acid ($C_9H_{19}COOH$), caprylic acid ($C_7H_{15}COOH$), caproic ($C_5H_{11}COOH$), or the like. However, other carbon numbers and structures may be used. In terms of a melting point, a lubricating property, and an economical aspect of the hydroxy fatty acid salts, the hydroxy stearic acid salt is suitably used.

As an example of a metal constituting the hydroxy stearic acid salt, there are lithium, calcium, zinc, magnesium, barium, sodium, potassium, and the like. However, in terms of a melting point and a hygroscopic property of the hydroxy stearic acid salt, the lithium is suitably used. According to the present invention, as a hydroxy stearic acid salt, the hydroxy lithium stearate is suitably used.

In addition, a hydroxy lithium stearate having arbitrary position and number of hydroxy group may be used. However, in terms of economical aspect, 12-hydroxy lithium stearate ($CH_3(CH_2)_5CH(OH)\ (CH_2)_{10}COOH$) having an single hydroxy group at position 12 is suitably used. In addition, since the 12-hydroxy lithium stearate having an average particle diameter of from 5 μm to 100 μm with a composition of from 0.3 wt % to 2 wt % can be easily manufactured by directly reacting a lithium compound with 12-hydroxy stearic acid ($CH_3(CH_2)_5CH(OH)\ (CH_2)_{10}COOH$) originated from ricinoleic acid ($CH_3(CH_2)_5CH(OH)CH_2CH{=}CH(CH_2)_7COOH$) which is a main component of inexpensive castor oil, it is possible to reduce production cost thereof. Therefore, by using the 12-hydroxy lithium stearate, it is possible to reduce production cost in the field of powder metallurgy. On the other hand, 1% of lithium stearate or like is remained as inevitable impurities originated from the castor oil. If purity thereof is too low, the flowing property may deteriorate. Therefore, it is preferable that the purity thereof is as high as possible.

Next, a warm molding method using the aforementioned warm molding raw material powder having a hydroxy fatty acid salt will be described.

In the warm molding method, the warm molding raw material powder according to the present invention is heated up to the warm molding temperature, and the heated warm molding raw material powder is filled in the mold and pressed to form a warm molding pressed body as a formed body having a higher pressing property than that of a room temperature molding. Subsequently, the warm molding pressed body is sintered to form a sintered body. The sintered body is pressed and reformed by using a reforming mold. After that, as needed, a cutting process is performed, so that a powder metallurgy product is obtained.

More specifically, firstly, a hydroxy fatty acid salt as a lubricant is added to a warm molding raw material powder containing metal such as iron as a main component in powder metallurgy. After that, a mixing process is performed by using a rotary mixer, so that a warm molding raw material powder is obtained.

Here, as described above, in order to obtain the flowing and flowing properties of the raw material powder, a composition of the hydroxy fatty acid salt in the warm molding raw material powder is in a range of from 0.3 wt % to 2 wt %, more preferably, from 0.5 wt % to 2 wt %, and a lubricant having a melting point below the warm molding temperature is not added. In addition, a lubricant having a melting point exceeding the warm molding temperature may be added. The hydroxy fatty acid salt is preferably a hydroxy stearic acid salt and, more preferably, a hydroxy lithium stearate. Among the hydroxy lithium stearate, a 12-hydroxy lithium stearate is most preferable.

Next, the warm molding raw material powder is dried up to the warm molding temperature by using a drier, and after that, filled in a mold which is heated up to the warm molding temperature.

In addition, in order to the lubricating property between the mold and the raw material powder, before the warm molding raw material powder is filled, a powder of hydroxy fatty acid salt may be attached on a forming surface of the mold in advance. In a case where the hydroxy fatty acid salt is attached on the mold, if the powder is electrically charged, and if the electrostatic property thereof is used, the hydroxy fatty acid salt can be easily attached. For the same reason as that of the aforementioned warm molding raw material powder, as a hydroxy fatty acid salt of this cases, the hydroxy fatty acid salt is preferably a hydroxy stearic acid salt and, more preferably, a hydroxy lithium stearate. Among the hydroxy lithium stearate, a 12-hydroxy lithium stearate is most preferable.

In addition, as the hydroxy fatty acid salt attached on the mold, the hydroxy fatty acid salt having an average particle diameter of 50 μm or less is used. If the average particle diameter of the hydroxy fatty acid salt is more than 50 μm, an amount of the hydroxy fatty acid salt attached on the mold is too much, a surface density of the formed body may be lowered.

The warm molding raw material powder filled in the mold is pressed with a predetermined pressure to form a warm molding pressed body. After that, the warm molding pressed body is detached from the mold, and a sintering process is performed to form a sintered body. Next, the sintered body is pressed and reformed by using a reforming mold.

In order to improve the lubricating property of the sintered body in the reforming mold, a powder of the hydroxy fatty acid salt may be attached on the reforming surface of the reforming mold in advance. Similar to the case of attaching a powder of the hydroxy fatty acid salt on the mold, if the powder is electrically charged, and if the electro-static property thereof is used, the hydroxy fatty acid salt can be easily attached.

Similar to the case of the mold, as a hydroxy fatty acid salt of this case, the hydroxy fatty acid salt is preferably a hydroxy stearic acid salt and, more preferably, a hydroxy lithium stearate. Among the hydroxy lithium stearate, a 12-hydroxy lithium stearate is most preferable. In addition, the average particle diameter thereof is less than 50 μm.

After that, as needed, a cutting process is performed, so that a powder metallurgy product is obtained.

As described above, the warm molding raw material powder according to the present invention contains the raw material powder in powder metallurgy and the hydroxy fatty acid salt having a average particle diameter of from 5 μm to 100 μm with a composition of from 0.3 wt % to 2 wt %, and more properly, from 0.5 wt % to 2 wt %. Therefore, the flowing property of the raw material powder at a time of heating at a temperature of from 150° C. to 190° C. does not deteriorate. In addition, higher lubricating and pressing properties at a time of pressing-molding than those of a conventional case of using lithium stearate can be obtained. In addition, since a lubricant having a melting point below the warm molding temperature is not contained, deterioration in the flowing property of the raw material powder can be securely prevented.

In addition, in the warm molding method according to the present invention, after the hydroxy fatty acid salt having an average particle diameter of 50 μm or less is attached on the mold in powder metallurgy in advance, the warm molding may be performed. Therefore, the lubricating property between the mold and the raw material powder can be improved.

The 12-hydroxy lithium stearate having an average particle diameter of from 5 μm to 100 μm can be easily and economically obtained by directly reacting a lithium compound with a 12-hydroxy stearic acid originated from inexpensive castor oil. Therefore, it is possible to reduce production cost thereof. Particularly, in order to reduce the production cost, the 12-hydroxy lithium stearate is suitably used as a hydroxy fatty acid salt.

The present invention is not limited to the aforementioned embodiment, but various modifications may be available.

EXAMPLES

Hereinafter, the present invention will be described more in detail by using examples.

As a raw material powder, an iron powder having an average particle diameter of 90 μm is used. A 12-hydroxy lithium stearate having an average particle diameter of 30 μm with a composition of from 0.3 wt % to 2 wt % is added to the iron powder, and a mixing process is performed by using a rotary mixer for 30 minutes, so that a warm molding raw material powder is obtained. Next, the warm molding raw material powder is heated at a temperature of from 140° C. to 200° C. in a drier. Next, a flow-ability of the warm molding raw material powder is measured by using a flow-ability measuring instrument which is heated at a temperature of from 140° C. to 200° C. In addition, in the measurement of the flow-ability, a 50 g warm molding raw material powder is inserted into a funnel tube having a diameter of 2.7 mm, and after that, a flowing time thereof is measured.

In addition, the warm molding raw material powder heated at a temperature of from 140° C. to 200° C. in the drier is filled in the mold which is heated at a temperature of from 140° C. to 200° C. by a heater and used to form a cylinder having a pressed area of 1 $cm^2$, and a warm molding pressed body is formed with a molding pressure of 8 $t/cm^2$ in a manner that a lubricant is not attached on a wall surface of the mold. A detaching pressure required for detaching the warm molding pressed body from the mold and a density of the warm molding pressed body are measured.

The measurement result for the flow-ability, the detaching pressure, and the density are shown in Tables 1 to 3.

COMPARATIVE EXAMPLES

In Comparative Example 1, instead of the 12-hydroxy lithium stearate of the aforementioned example, a lithium stearate having an average particle diameter of 30 μm is used. Similar to the example, the flow-ability, the detaching pressure, and the density are measured. In addition, a lithium stearate manufactured by directly reacting a lithium compound with a stearic acid originated from beef tallow is used as the lithium stearate.

In Comparative Example 2, a 12-hydroxy lithium stearate with a composition of 0.2 wt % is added, and the flow-ability, the detaching pressure, and the density are measured. In Comparative Example 3, a 12-hydroxy lithium stearate with a composition of 30 wt % is added, and the flow-ability, the detaching pressure, and the density are measured. The measurement results are shown in Tables 1 to 3.

TABLE 1

Comparison of Flowing Property

| | Lubricant | Amount of Lubricant | Flowing Property (s/50 g) 140° C. | 150° C. | 160° C. | 170° C. | 180° C. | 190° C. | 200° C. |
|---|---|---|---|---|---|---|---|---|---|
| Example 1 | 12-hydroxy lithium stearate | 0.30% | 20 | 20 | 19 | 19 | 19 | 19 | x |
| Example 2 | 12-hydroxy lithium stearate | 0.50% | 20 | 19 | 20 | 19 | 19 | 20 | x |
| Example 3 | 12-hydroxy lithium stearate | 0.75% | 20 | 20 | 20 | 20 | 19 | 21 | x |
| Example 4 | 12-hydroxy lithium stearate | 2.00% | 21 | 21 | 20 | 20 | 20 | 22 | x |
| Comparative Example 1 | lithium stearate | 0.75% | 22 | x | x | x | x | x | x |
| Comparative Example 2 | 12-hydroxy lithium stearate | 0.20% | 20 | 20 | 19 | 19 | 18 | 19 | x |
| Comparative Example 3 | 12-hydroxy lithium stearate | 3.00% | 23 | 22 | 21 | 21 | 21 | 22 | x |

x: Not Flowing

TABLE 2

Comparison of Lubricating Property

| | Lubricant | Amount of Lubricant | Detaching Pressure (kN) 150° C. | 190° C. |
|---|---|---|---|---|
| Example 1 | 12-hydroxy lithium stearate | 0.30% | 16 | 15 |
| Example 2 | 12-hydroxy lithium stearate | 0.50% | 13 | 11 |
| Example 3 | 12-hydroxy lithium stearate | 0.75% | 10 | 9 |
| Example 4 | 12-hydroxy lithium stearate | 2.00% | 6 | 5 |
| Comparative Example 1 | lithium stearate | 0.75% | 11 | — |

TABLE 2-continued

Comparison of Lubricating Property

| | Lubricant | Amount of Lubricant | Detaching Pressure (kN) 150° C. | 190° C. |
|---|---|---|---|---|
| Comparative Example 2 | 12-hydroxy lithium stearate | 0.20% | x | x |
| Comparative Example 3 | 12-hydroxy lithium stearate | 3.00% | 4 | 4 |

x: Occurrence of Scratch (Defective Forming)

TABLE 3

Comparison of Pressing Property

| | Lubricant | Amount of Lubricant | Density ($g/cm^3$) 150° C. | 190° C. |
|---|---|---|---|---|
| Example 1 | 12-hydroxy lithium stearate | 0.30% | 7.52 | 7.57 |
| Example 2 | 12-hydroxy lithium stearate | 0.50% | 7.51 | 7.56 |

TABLE 3-continued

Comparison of Pressing Property

| | Lubricant | Amount of Lubricant | Density ($g/cm^3$) 150° C. | 190° C. |
|---|---|---|---|---|
| Example 3 | 12-hydroxy lithium stearate | 0.75% | 7.46 | 7.5 |
| Example 4 | 12-hydroxy lithium stearate | 2.00% | 7.09 | 7.1 |
| Comparative Example 1 | lithium stearate | 0.75% | 7.43 | — |
| Comparative Example 2 | 12-hydroxy lithium stearate | 0.20% | x | x |
| Comparative Example 3 | 12-hydroxy lithium stearate | 3.00% | 6.77 | 6.77 |

x: Occurrence of Scratch (Defective Forming)

Referring to Tables 1 to 3, it can be seen that, in Comparative Example 1 using lithium stearate, that is, a conventional lubricant, since there is no flowing at a temperature of 150° C. or more, the flowing property cannot be measured; in Example 1 using the 12-hydroxy lithium stearate, the flowing property can be measured up to 190° C. Therefore, it can be understood that, if the 12-hydroxy lithium stearate is used, the flowing property can be improved.

In addition, in comparison with Comparative Example 1, the detaching pressure of Example 3 having the same additive amount is low. Therefore, it can be understood that, if 12-hydroxy lithium stearate is used, the lubricating property can be improved.

In addition, in comparison with Comparative Example 1, the density of Example 3 having the same additive amount is high. Therefore, it can be understood that, if 12-hydroxy lithium stearate is used, the density can be improved.

In addition, in Comparative Example 2, since an amount of lubricant is too small, the lubricating property is insufficient, so that it is impossible to perform the molding. In addition, in Comparative Example 3, since an amount of lubricant is too large, the pressing property cannot be improved although the temperature is increased up to 190° C.

It is considered that the reason that the flowing, lubricating, and pressing properties can be improved by using the 12-hydroxy lithium stearate is as follows. Conventionally, it is known that, the crystal structure of the lithium stearate is changed before the temperature thereof reaches the melting point (pleomorphic phenomenon). However, according to the present invention, since a hydroxy group is attracted to the lithium stearate, the crystal structure is not easily changed at the warm molding temperature. Therefore, it is considered that there occurs a difference in characteristics of the flowing, lubricating, and pressing properties. FIGS. 1 and 2 show results of thermal analysis of the lithium stearate and 12-hydroxy lithium stearate. In the result of the thermal analysis of the lithium stearate shown in FIG. 1, in addition to a melting point peak at the right side, two or three peaks can be seen at a low temperature. On the contrary, in the result of the thermal analysis of the 12-hydroxy lithium stearate shown in FIG. 2, excluding the melting point peak at the right side, any peak cannot be seen at a low temperature. Therefore, it is considered that the crystal structure is not easily changed at a high temperature.

On the other hand, in general, the flowing property at a high temperature can be improved by adjusting production conditions of the lithium stearate and controlling a crystal structure, a particle size distribution, and a particle shape. However, in a case where a crystal structure is not easy to control or a case where the pressing property deteriorates, in order to stably manufacture the lithium stearate with a general manufacturing method, the 12-hydroxy lithium stearate is considered to be preferable.

The invention claimed is:

1. A warm molding method comprising:

attaching a powder consisting of a hydroxyl fatty acid salt having an average particle diameter of 50 μm or less on a forming surface of a mold; and using a warm molding raw material powder in powder metallurgy, the warm molding raw material powder comprising a lubricant which consists of a hydroxyl fatty acid salt having an average particle diameter of from 5 μm to 100 μm in a range of from 0.3 wt % to 2 wt %.

2. The warm molding method according to claim 1, wherein the hydroxy fatty acid salt is a hydroxy fatty acid lithium.

3. The warm molding method according to claim 2, wherein the hydroxy fatty acid lithium is hydroxy lithium stearate.

4. The warm molding method according to claim 3, wherein the hydroxy lithium stearate is 12-hydroxy lithium stearate.

5. The warm molding method according to claim 1, wherein the warm molding raw material powder is heated up to a temperature of 150 to 190° C.

6. The warm molding method according to claim 1, wherein the hydroxy fatty acid salt is a hydroxy stearic acid salt.

7. The warm molding method according to claim 6, wherein the hydroxy stearic acid salt is hydroxy lithium stearate.

8. The warm molding method according to claim 7, wherein the hydroxy lithium stearate is 12-hydroxy lithium stearate.

* * * * *